US005424819A

United States Patent [19]

Menjo

[11] Patent Number: 5,424,819

[45] Date of Patent: Jun. 13, 1995

[54] IMAGE-FORMING APPARATUS CAPABLE OF CONTROLLING APPLICATION TIMING OF RELEASING AGENT

[75] Inventor: Takeshi Menjo, Tokyo, Japan

[73] Assignee: Canon Kabushiki Kaisha, Tokyo, Japan

[21] Appl. No.: 160,367

[22] Filed: Oct. 15, 1993

Related U.S. Application Data

[63] Continuation of Ser. No. 932,731, Aug. 25, 1992, which is a continuation of Ser. No. 571,129, Aug. 23, 1990.

[30] Foreign Application Priority Data

Aug. 31, 1989 [JP] Japan ..... 1-225358

[51] Int. Cl.[6] ..... G03G 15/20

[52] U.S. Cl. ..... 355/284; 219/216; 118/261

[58] Field of Search ..... 355/282, 284–286; 219/216, 388; 432/60; 118/60, 101, 260, 261

[56] References Cited

U.S. PATENT DOCUMENTS

| | | | |
|---|---|---|---|
| 4,011,353 | 3/1977 | Okamoto et al. | 118/60 X |
| 4,149,797 | 4/1979 | Imperial | 355/290 |
| 4,352,551 | 10/1982 | Iwao | 355/284 |
| 4,378,752 | 4/1983 | Knechtel | 118/60 |
| 4,393,804 | 7/1983 | Nygard et al. | 118/60 |
| 4,429,990 | 2/1984 | Tamary | 118/60 X |
| 4,541,707 | 9/1985 | Yoshinaga | 355/284 |
| 4,549,803 | 10/1985 | Ohno et al. | 355/284 |
| 4,593,992 | 6/1986 | Yoshinaga et al. | 355/284 |
| 4,751,548 | 6/1988 | Lawson | 355/284 |
| 4,920,382 | 4/1990 | Mills et al. | 355/284 |
| 4,942,433 | 7/1990 | Stuart | 355/284 |

FOREIGN PATENT DOCUMENTS

| | | |
|---|---|---|
| 024154 | 2/1981 | European Pat. Off. . |
| 58-168073 | 10/1983 | Japan . |
| 59-139073 | 8/1984 | Japan . |
| 61-184577 | 8/1986 | Japan . |
| 2148190 | 5/1985 | United Kingdom . |

*Primary Examiner*—R. L. Moses

*Attorney, Agent, or Firm*—Fitzpatrick, Cella, Harper & Scinto

[57] ABSTRACT

This invention relates to a fixing device including a pair of rotary members for pinching and transporting therebetween a recording material bearing an unfixed image, thereby fixing the unfixed image, and applicator means for applying releasing agent onto at least one of the paired rotary members. When the recording material is a resinous recording material, the applicator means is adapted to apply the releasing agent excluding a portion of the rotary member corresponding to the leading end portion of the recording material.

30 Claims, 5 Drawing Sheets

IMAGE-FORMING APPARATUS CAPABLE OF CONTROLLING APPLICATION TIMING OF RELEASING AGENT

This application is a continuation of application Ser. No. 07/932,731, filed Aug. 25, 1992, which is a continuation of application Ser. No. 07/571,129, filed Aug. 23, 1990, both now abandoned.

BACKGROUND OF THE INVENTION

1. Field of the Invention

The present invention relates to a fixing device for fixing a toner image by pinching and advancing a recording material bearing said toner image with a pair of rotary members, and more particularly to a fixing device provided with means for applying releasing agent onto said rotary members.

2. Related Background Art

Among the fixing devices for fixing toner image, there is being widely employed a heat roller fixing device in which the recording material is pinched and transported by a heat roller heated by a heater and a pressure roller pressed to said heat roller.

An example of such heat roller fixing device is shown in FIG. 4.

A recording material T bearing toner image thereon enters a nip 38 between a fixing roller 21 and a pressure roller 25, and the toner image is fixed to said recording material by heat and pressure.

For preventing offsetting of the toner, there is provided a releasing agent applicator 32 in a predetermined position of the fixing device 17. In said applicator 32, silicone oil 33 (for example dimethyl silicone oil KF96300CS manufactured by Shinetsu Chemical Co., Ltd.) contained in an oil tank 32*a* is picked up by rollers 34, 35, limited to a predetermined amount by a regulating blade 40, and applied onto the fixing roller 33.

Also in order to avoid wasted consumption of the silicone oil, it is also known to effect on-off contact between the oil applying roller 35 and the fixing roller 21.

FIG. 4 illustrates the application area of the silicone oil in case of on-off contact of the oil applying roller 35. As will be understood from FIG. 4, the oil 33 is applied earlier than the leading end of the recording material T, so that the oil reaches nip 38 prior to the entry of the recording material into said nip.

The recording material is generally composed of paper, but resinous films are being used more widely for meeting various copying requirements. Most well-known is overhead projector film, or so-called transparency film, but recording films are used for other various purposes.

However such film-shaped or resinous recording materials, having smoother surfaces than paper, pose difficulty in entering the nip between the fixing roller 21 and the pressure roller 25. Thus the recording material stops advancing through said nip upon contacting said nip of said rollers, eventually resulting in sheet jamming. Particularly, the presence of early applied oil in the nip causes the slippage of film with a smooth surface, thus enhancing the difficulty of entry into the nip.

Also such film, even if thermally resistant, may be softened or become undulated before entering the nip due to the heat received from the fixing roller or the pressure roller. Such fact also aggravates the difficulty of entry into the nip.

Use of such film is also known to require the reduction of the fixing roller speed, thereby effecting slower image fixation for the resinous recording material or the like requiring sufficient image fixation. For example, the speed of the fixing roller is reduced, from 90 mm/sec for paper, to 20 mm/sec for a resinous recording material. Such lower speed is employed in the case of a transparency film, for increasing the optical transmittance of toner and is employed in the case of fixing plural toner layers onto the resinous recording material as in a color image forming apparatus for achieving sufficient fixation even in the lowermost toner layer that is most difficult to fix. However such low-speed rotation of the fixing roller also increases the difficulty of entry of the recording material into the nip, because of the presence of a larger amount of oil at the entrance side of the nip 38 due to the low-speed rotation of the fixing roller and because of the enhanced softening and undulation of the recording material resulting from the prolonged exposure of the recording material to the heat.

SUMMARY OF THE INVENTION

An object of the present invention is to provide a fixing device enabling secure entry even of a resinous recording material into the nip.

Another object of the present invention is to provide a fixing device enabling secure entry of the recording material into the nip even when the fixing speed is changed to a low speed.

Still another object of the present invention is to provide a fixing device enabling secure entry of the recording material into the nip even when a large amount of releasing agent is applied.

Still another object of the present invention is to provide a fixing device capable of applying the releasing agent excluding the leading end portion of the recording material.

Still other objects of the present invention will become fully apparent from the following description.

DESCRIPTION OF THE PREFERRED EMBODIMENTS

Now the present invention will be clarified in detail by preferred embodiments thereof shown in the attached drawings.

Figure 2:
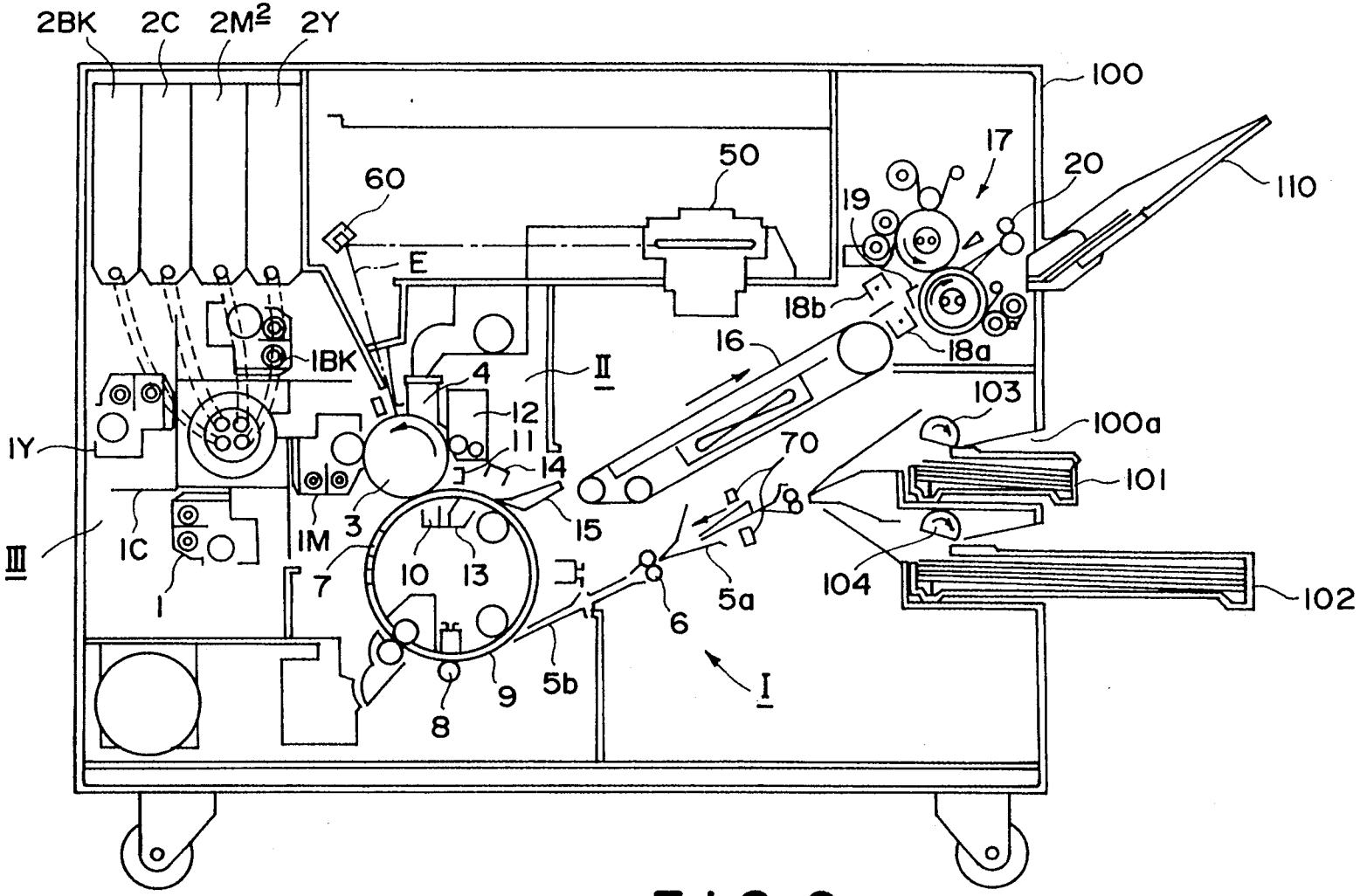
FIG. 2 is a cross-sectional view of an image forming apparatus employing the fixing device shown in FIG. 1.

FIG. 2 illustrates an image forming apparatus equipped with a fixing device embodying the present invention.

Said image forming apparatus is composed of a transport system I, provided from a side (right-hand side in FIG. 2) of a main body 100 to the approximate center thereof, for transporting a transfer material serving as the recording material; a latent image forming unit II positioned close to a transfer drum 9 constituting a part of said transport system I; developing means, or a rotary developing unit III, positioned close to said latent image forming unit II; and a developer feeding unit 2 positioned close to said rotary developing unit II.

The above-mentioned transport system I is composed of transfer material feeding trays 101, 102 detachably attached to apertures 100*a* formed on a lateral wall (right-hand wall in FIG. 2) of the main body 100; feed rollers 103, 104 positioned above said trays 101, 102; sheet guide members 5*a*, 5*b* positioned close to said feed rollers 103, 104 and provided with feed rollers 6; a transfer drum 9 positioned close to said sheet guide members 5*b*, rendered rotatable in an arrowed direction and provided in the order from the upstream side, along the external periphery, with a contact roller 8, a gripper 7, a separating charger 14 and a separating finger 15; and, along the internal periphery, with a transfer charger 10 and a separating charger 13; a conveyor belt 16 positioned close to said separating finger 15; a discharge tray 110 positioned close to the downstream end of said conveyor belt 16, detachably mounted on the main body 100 and extending to the exterior thereof; and a fixing device 17 of the present invention positioned close to said discharge tray 110.

The above-mentioned latent image forming unit II is composed of an image bearing member or a photosensitive drum 3 rendered rotatable in a direction shown in FIG. 2 and maintained at the external periphery in contact with that of said transfer drum 9; a charge-eliminating charger 11, a cleaner 12 and a primary charger 4 positioned in this order from the upstream side of the rotation along the external periphery of said photosensitive drum 3; image exposure means 50 such as a laser beam scanner for forming an electrostatic latent image on the external periphery of said photosensitive drum 3; and reflector means such as a polygon mirror 60.

The above-mentioned rotary developing unit III comprises a rotary member 1; and a magenta developing unit 1M, a cyan developing unit 1C, a yellow developing unit 1Y and a black developing unit 1BK mounted on said rotary member 1 and to respectively develop the latent image into a visible image in a position opposed to the external periphery of the photosensitive drum 3.

The above-mentioned developing feeding unit 2 is provided with a yellow hopper 2Y, a magenta hopper 2M, a cyan hopper 2C and a black hopper 2BK positioned in mutually adjacent manner and respectively holding developers, consisting of powered toners, of different colors.

In the following there will be briefly explained the operating sequence of the above-explained image forming apparatus, when operating in full-color mode.

As the photosensitive drum 3 is rotated in a direction indicated by the arrow in FIG. 2, it is uniformly charged by the primary charger 4. Subsequently said drum is subjected to imagewise exposure with a laser beam E modulated with a magenta image signal of an original image (not shown), whereby an electrostatic latent image is formed on said drum 3. Said latent image is developed by the magenta developing unit 1M brought into the developing position in advance by the rotation of the rotary member 1.

A transfer material transported through the guide members 5*a*, feed rollers 6 and guide members 5*b* is supported by the gripper 7 at a predetermined timing and is electrostatically wound on the transfer drum 9 by means of the contact roller 8 and an electrode positioned opposite to said roller. Said transfer drum 9 rotates in a direction indicated by the arrow in FIG. 2 in synchronization with the photosensitive drum 3, whereby the visible image developed by the magenta developing unit 1M is transferred onto the transfer drum 9 by the transfer charger 10, at the contact position of said drum with the photosensitive drum 3. The transfer drum 9 continues rotation in preparation for the transfer of an image of the next color (cyan in the case of FIG. 2).

The photosensitive drum 3 is subjected to charge elimination by the charge-eliminating charger 11, and cleaning by the cleaner 12, then charged again by the primary charger 4 and again subjected to imagewise exposure according to the cyan image signal. The rotary developing unit III rotates to bring the cyan developing unit 1C to the aforementioned developing position during the formation of an electrostatic latent image, corresponding to the cyan image signal, on the photosensitive drum 3, and effects the image development with cyan color.

Subsequently the above-explained procedure is repeated for yellow and black colors. Upon completion of transferring images of the four colors, the four-colored visible images formed on the transfer material are subjected to charge elimination by the chargers 13, 14. Then the transfer material is released from the gripper 7, separated from the transfer drum 9 by the separating filter 15, and transported to the conveyor belt 16.

Then, prior to entry into the fixing device 17, the transfer material is charged again by pre-fixation chargers 18*a*, 18*b*, then guided by entrance guide members 19, subjected to image fixation by heat between a fixing roller 21 and a pressure roller 25 (cf. FIG. 1) of the fixing device 17, and is finally discharged from the main body 100 by discharge rollers 20.

Thus a cycle of full-color printing sequence is completed to provide a desired full-color printed image.

In the following there will be explained the toner, serving as the developer employed in the above-explained image forming apparatus.

The toner employed in a color image forming apparatus is required to have satisfactory melting and mixing properties when heated, and there is preferred sharp-melting toner with a low softening point and a low viscosity in molten state. Such sharp melting toner extends the color reproduction range of the copy, thus providing a color copy faithful to the original image.

Such sharp-melting toner can be prepared by the blending in fused state, crushing and classification of, for example, a polyester resin, styrene-acrylonitrile resin, coloring material (dye or sublimable dye), charge controlling agent, etc. If necessary there may be added an adding step for adding various additives to the toner.

In color toners, in consideration of the fixing property and sharp melting property, the binder resin is preferably composed of polyester resin. Sharp-melting polyester resin can be composed of a macromolecular compound having ester bonds on a main molecular chain composed of diols and dicarboxylic acids.

The toner to be employed in the image forming apparatus shown in FIG. 2 advantageously employs sharp-melting polyester resin with a softening point in a range of 60°–150° C., preferably 80°–120° C.

Figure 3:
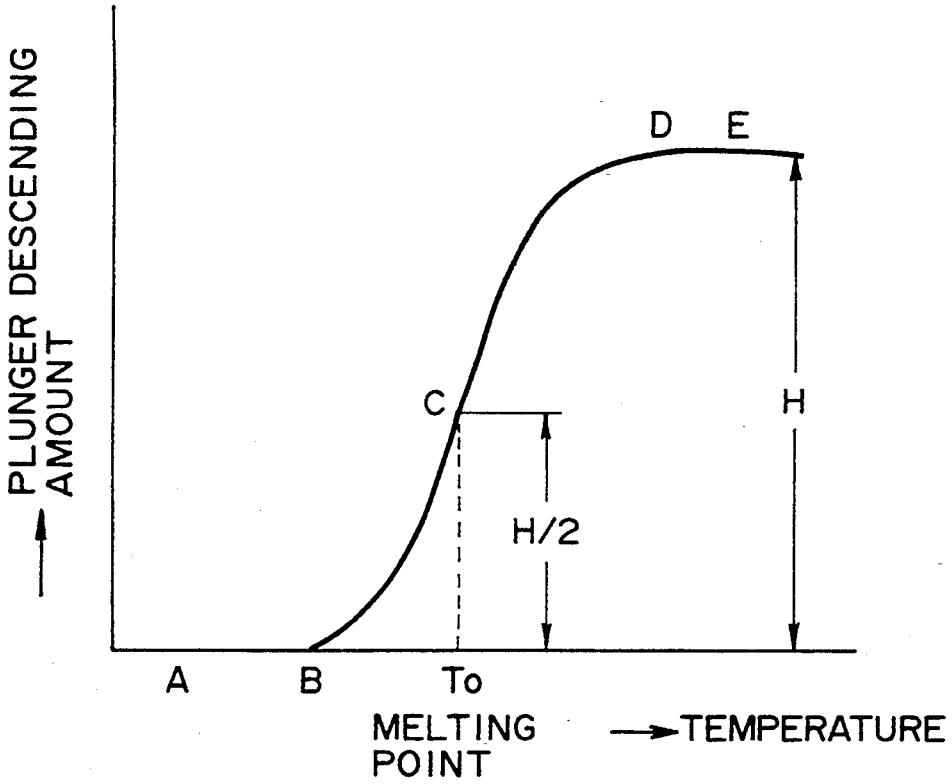
FIG. 3 is a chart showing the softening of toner employed in the image forming apparatus shown in FIG. 2.

FIG. 3 shows the softening characteristic of such sharp-melting toner.

The softening characteristic of toner can be determined by a curve, indicating the amount of descent of plunger as a function of temperature (hereinafter called "S-shaped softening curve"), obtained on a flow tester Model CFT-500 (Shimazu Mfg. Co.) with a dye (nozzle) of a diameter of 0.5 mm and a thickness of 1.0 mm, with an extrusion load of 50 kgs. and with a pre-heating of 300 seconds at an initial temperature of 80° C. and a subsequent temperature increase rate of 5° C./min. The toner specimen is finely divided power of 1–3 grs., and a plunger of a cross section of 1.0 $cm^2$ is employed.

In the course of temperature increase at a constant rate, as shown in FIG. 3, the toner is gradually heated and starts to flow (plunger descent range A–B). As the temperature is raised further, the molten toner flows faster (B–D), and the descent of the plunger is eventually terminated (D–E). In FIG. 3, the height H of the S-shaped curve indicates the total flow amount, and a temperature $T_0$ corresponding to a point C equal to a half of said height H indicates the softening point of the toner.

Sharp-melting resin can be defined by satisfying conditions $T_1=90°–150°$ C. and $|\Delta T|=|T_1-T_2|=5°–30°$ C., wherein $T_1$ is a temperature at which the molten viscosity is $10^5$ cp and $T_2$ is a temperature at which the molten viscosity is $5\times10^4$ cp.

The sharp-melting resin with the above-mentioned viscosity-temperature characteristic is featured by a very sharp viscosity decrease when heated. Such viscosity decrease induces appropriate mixing of the uppermost and lowermost toner layers and rapidly increases the transparency of the toner layer itself, thereby realizing satisfactory subtractive color mixing.

However, such sharp-melting color toner generally has a high affinity and tends to cause offsetting to the fixing roller.

Figure 1:
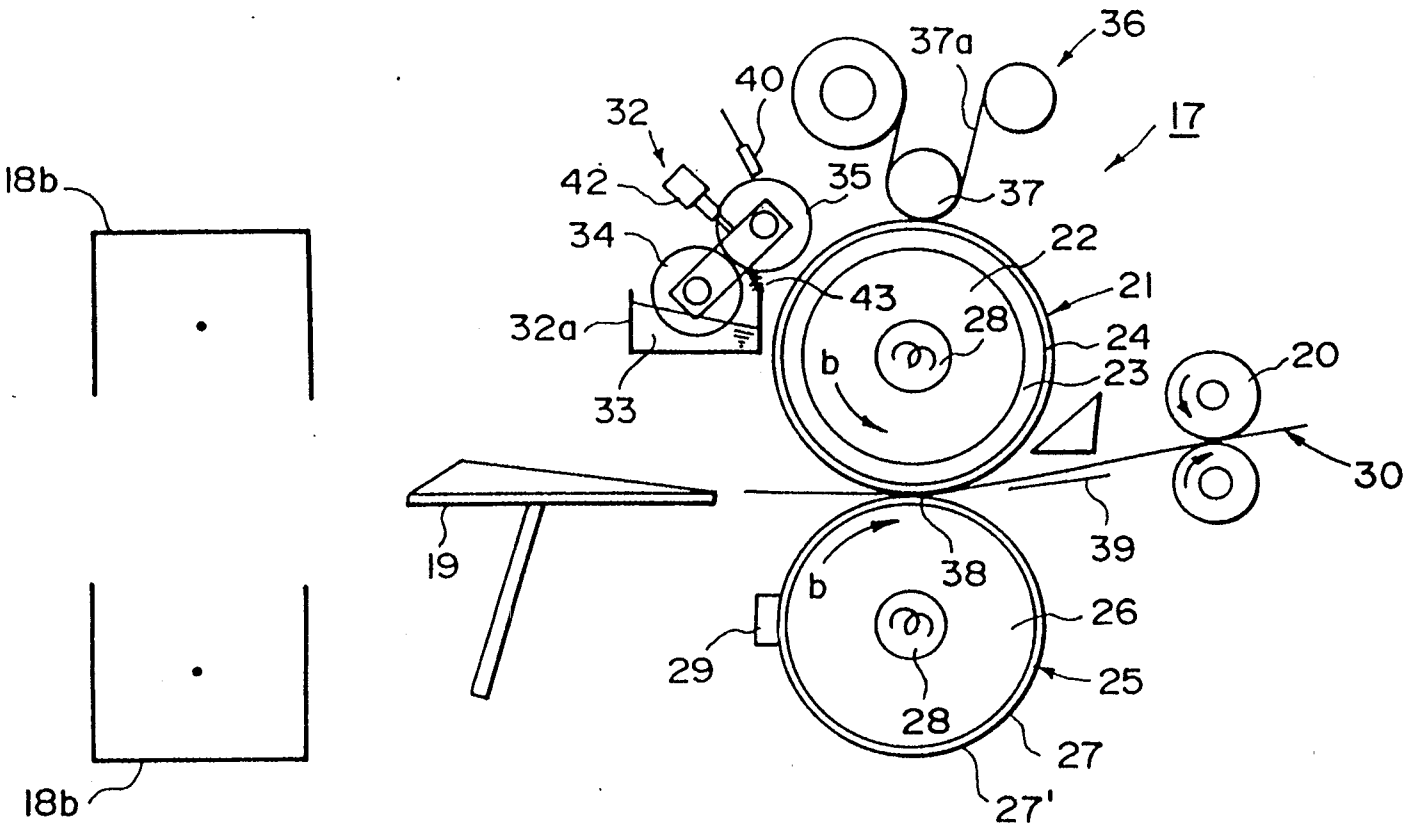
FIG. 1 is a cross-sectional view of a fixing device embodying the present invention.

Now reference is made to FIG. 1 and the details of the fixing device 17 will be explained.

A fixing roller 21 is composed of an aluminum core 22, a high temperature vulcanized (HTV) silicone rubber layer 23 of a predetermined thickness formed around said core 22, and a low temperature vulcanized (LTV) silicone rubber layer 24 of a thickness of 200 μm formed around the rubber layer 23. Under said fixing roller 21 there is provided a pressure roller 25, composed of an aluminum core 26, an HTV silicone rubber layer 27 of a predetermined thickness, and a surfacial resin coating 27'.

In said fixing roller 21 and pressure roller 25 there are respectively provided halogen heaters 28 serving as heat sources. A thermistor 29 is provided in contact with the pressure roller 25 and serves for on/off control of the current to the halogen heaters 28.

Thus the surfaces of the fixing roller 21 and the pressure roller 25 are maintained at a temperature suitable for fixing the unfixed toner image onto the transfer material 30, for example 170° C. Rollers 21, 25 are driven in a direction b, shown in FIG. 1, by a driving device (not shown).

Also, for facilitating the release of toner from the fixing roller 21, there is provided a releasing agent applicator 32 for applying releasing agent to the fixing roller.

The releasing agent 33 (for example dimethyl silicone oil KF96, 300 cs, manufactured by Shinetsu Chemical Co.) contained in an oil tank **32*a* is picked up by rollers 34, 35, then is regulated in the amount by a regulating blade 40 and is coated on the fixing roller 21. A plunger 42 and a spring 43 cause on-off contacts of the releasing agent applicator roller 35 with the fixing roller 21**, whereby the silicone oil is applied when both rollers are mutually contacted.

The applied amount of the silicone oil can be determined in the following manner.

The applied amount x (gr.) per A3-sized transfer material (white paper) can be determined by:

$$x=(C+A_1-B-A_2)/50$$

wherein:

$A_1$: weight of 50 A4-sized transfer materials (white papers);

B: weight of $A_3$ 50 transfer materials after passing between the fixing and pressure rollers without image transfer or silicone oil application onto the fixing roller;

$A_2$: weight of another 50 A4-sized transfer materials (white papers); and

C: weight of $A_2$ 50 transfer materials after passing between the fixing and pressure rollers without image transfer but with silicone oil application onto the fixing roller.

In the present fixing device, the releasing agent is applied in an amount of about 0.1 grams in order to achieve satisfactory fixation of the above-mentioned sharp-melting color toner, and to release the toner without offsetting. In the case of a color image forming apparatus, such offset phenomenon is marked because plural toner layers of M, C, Y and Bk colors are formed on the transfer material.

In the present fixing device, the releasing agent is applied onto the fixing roller 21 by the contacts of the roller 35 therewith, and reaches the nip 38 of the fixing roller 21 and the pressure roller 25 by the rotation of said roller 21.

In a predetermined position of the fixing device 17, a cleaning device 36 is provided for removing the remaining toner by offsetting on the fixing roller 21, and is composed of a cleaning web **37*a* which is maintained in contact with the fixing roller 21 by a pressure spring 37. Said cleaning web 37*a* serves to clean the fixing roller 21**.

The transfer material 30, having received the toner image, is transported by the conveyor belt 16 and passes between the pre-fixation chargers **18*a*, 18*b*. The transfer material 30 and the toner image are charged again by the charger 18*a* with positive polarity same as that of the transfer charger 10 (FIG. 2) and by the charger 18*b* with negative polarity opposite to that of the charger 18a**.

Subsequently the transfer material 30 is guided by an entrance guide member 19, and enters into the nip of the fixing roller 21 and the pressure roller 25, whereby the toner image is fixed to the transfer material 30 by the heat and pressure exerted by said rollers 21, 25.

Then the transfer material 30 is guided by a discharge guide member 39 and is discharged from the main body by discharge rollers 20.

The rotating speed of the fixing roller in the present embodiment is 90 mm/sec in case of image formation on ordinary paper, or 25 mm/sec in case of image formation on a resinous recording material.

When a resinous recording material is fed, a photosensor 70 provided in the transport path for the recording material, upstream of the image transfer position, detects that the recording material is a transparent resinous recording material. In response to the detection signal, the rotating speed of the fixing roller 21 and the pressure roller 25 is controlled at 25 mm/sec at image fixation, and the contact timing of the applying roller 35, for applying silicone oil, with the fixing roller 21 is controlled in such a manner that the contact is made after passing the position of the fixing roller corresponding to the leading end of the resinous recording material.

Since the silicone oil is applied onto the fixing roller excluding a portion corresponding to the leading end of the resinous recording material, there can be prevented the jamming of the resinous recording material immediately in front of the nip, resulting from the slippage caused by the silicone oil.

When non-transparent paper is fed, the rotating speed of the fixing roller 21 and the pressure roller 25 at fixing is regulated at 90 mm/sec and the applicator roller 35 contacts the fixing roller upstream of the position corresponding to the leading end of the recording material, because ordinary paper, different from the resinous recording material, absorbs the releasing agent and will otherwise show difference in luster between an area coated with the releasing agent and an uncoated area.

In the present embodiment, in case the recording material is paper, it is free from unevenness in luster because the releasing agent is coated over an area exceeding the recording material. Since paper surfaces are more course than resinous film such as transparency film, jamming resulting from failure of entry into the nip caused by slippage by the presence of the releasing agent can be avoided. Also, the paper is free from thermal deformation in front of the nip because of the faster fixing speed than for resinous film, and can securely enter the nip even if the releasing agent is already coated.

Figure 4:
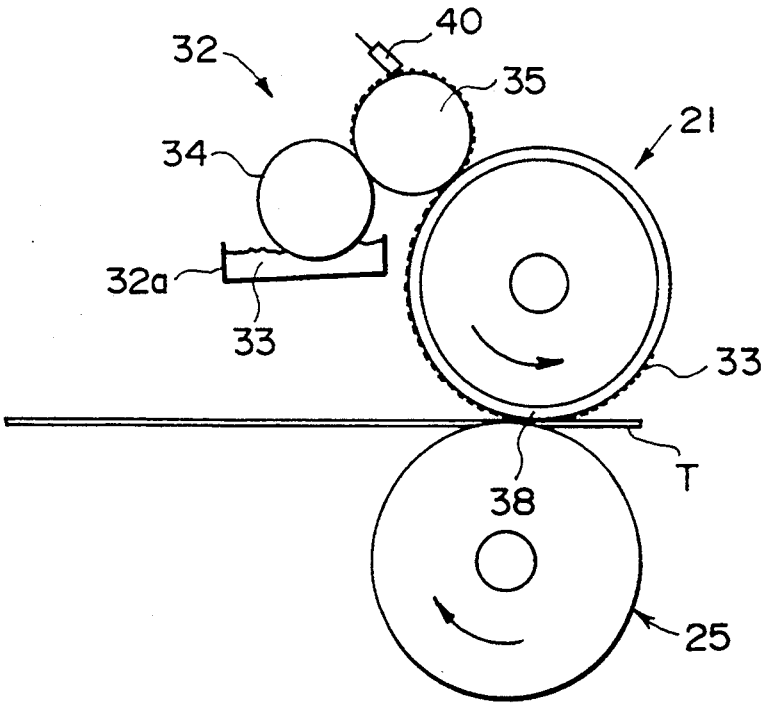
FIG. 4 is a view showing the state of application of releasing agent, as background of the present invention.
Figure 5:
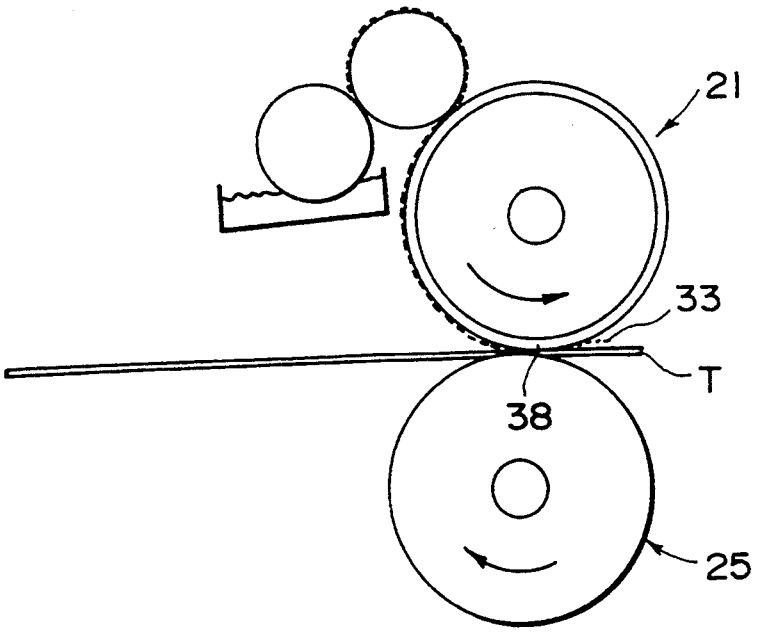
FIG. 5 is a view showing the state of application of releasing agent in an embodiment of the present invention.

FIG. 5 shows the state of coating of the releasing agent in the case of the resinous recording material. As will be apparent from the comparison with FIG. 4, the silicone oil is applied so as not to coat the leading end of the recording material.

Figure 6:
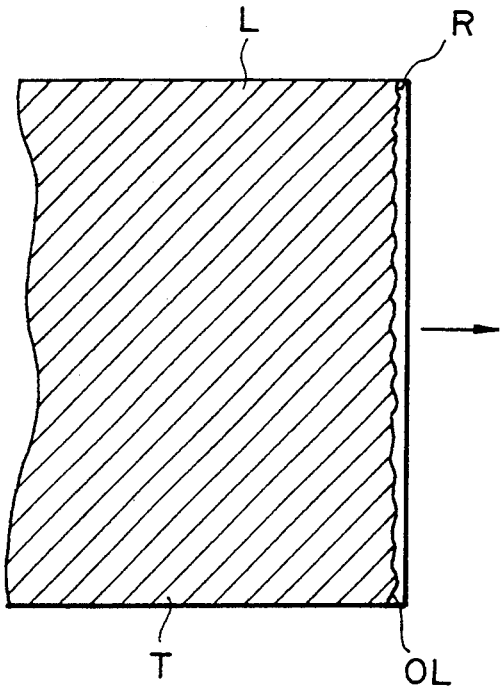
FIG. 6 is a view showing the state of releasing agent on a resinous recording material in an embodiment of the present invention.

FIG. 6 also shows the distribution of oil on the resinous film, wherein L indicates the resinous recording material, an arrow indicates the moving direction of the recording material and OL indicates a starting line of coating of the oil. Oil is coated in a hatched area L, but not in a blank area R.

As will be apparent from FIG. 6, the leading end portion of the resinous film is free from oil.

The uncoated length is within 10 mm, preferably within 5 mm at the leading end of the resinous recording material, because, within such range, the absence of oil scarcely affects the off-setting and the recording material can be separated by its rigidity from the fixing roller even without the oil.

Also in recent electrophotographic copying machines, a leading end portion of several millimeters is made a non-imaging area in order to facilitate the sheet separation after image transfer or after image fixation. In such apparatus, said uncoated area is preferably contained in such non-imaging area.

Also some transparent resinous recording materials have a printed area of about 10 mm at the leading end of the material, in order to enable detection of the recording material and detection of transparent resinous film by the difference in transmittance between the transparent film part and the printed part. In such recording material, said uncoated area is preferably contained in said printed area.

On the other hand, the length of said uncoated area is preferably at least 0.5 mm, more preferably at least 1 mm.

Presence of such uncoated area securely prevents the slippage, caused by the oil at the leading end of the resinous recording material.

In the following there will be explained examples of the resinous recording material and examples of fixation of such recording materials.

Figure 7A:
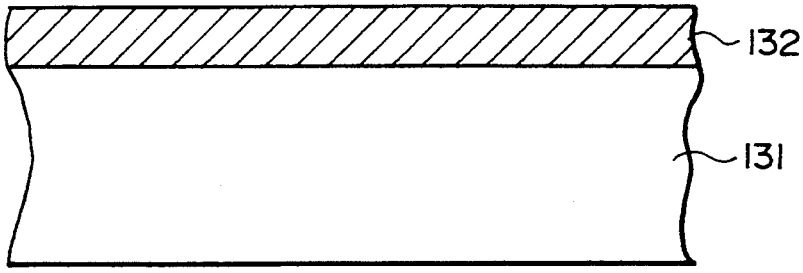
FIGS. 7A and 7B are cross-sectional views of resinous films employed in embodiments of the present invention.
Figure 7B:
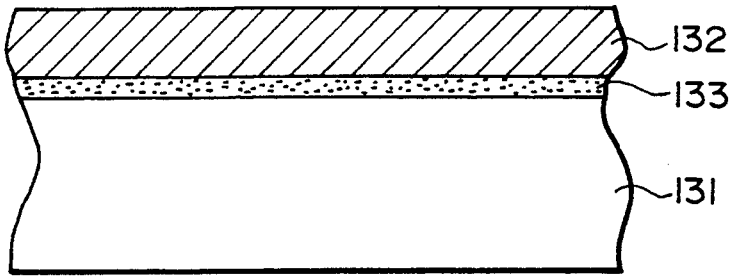

FIGS. 7A and 7B illustrate embodiments of transparent laminate film.

A substrate film 131, constituting a first transparent resin layer, is composed of a thermally resistant resin film with a maximum temperature of use higher than 100° C., free from significant thermal deformation by the heating at the image fixation, such as polyethylene terephthalate (PET), polyamide or polyimide. Particularly preferred is polyethylene terephthalate in consideration of thermal resistance and transparency. The thickness of the film 131 has to be enough to prevent the formation of creases even when the film is softened by the heat of fixation, and should be 50 μm at a minimum. On the other hand, since the optical transmittance of the film is lost at a larger thickness, the thickness of the film 131 should not exceed 200 μm, and would preferably be no greater than 150 μm.

An upper coating layer 132 constitutes a second transparent resin layer for improving the transmittance of the color image after fixation. Said layer 132 is required to be mutually soluble with the binder resin of the toner constituting the color image, in the temperature range of heating for image fixation. The mutual solubility with the binder resin of the toner means that the resin of the layer 132 and the resin of the toner do not form a boundary in the image after fixation. For selecting the material for the layer 132, the solubility parameter of the layer 132 is selected within ±1.5, preferably within ±1.0 of that of the toner resin.

The solubility parameter of resin is available from published materials, such as Polymer Handbook. For example, the aforementioned polyester resin employed as the toner binder resin has a solubility parameter of about 11.0. Consequently the layer 132 can be composed of thermoplastic resin with a solubility parameter within a range of 11.0±1.5, such as polyester resin, polymethyl methacrylate, epoxy resin, polyurethane resin, polyvinyl chloride or vinyl chloride-vinyl acetate copolymer.

The thermoplastic resin to be employed in the layer 132 of the present embodiment is additionally required to have a molten viscosity, at the softening point of the binder resin of the toner, which is within a range of 5 to 100 times, preferably 10 to 100 times, of the molten viscosity of said binder resin of the toner. Stated differently, in the fixing temperature range, the transparent resin of the layer 132 has a higher elasticity than the binder resin of the toner. On the other hand, if the molten viscosity of said transparent resin is close to that of the binder resin of the toner at the image fixation, when the fixation is conducted under such a condition that sufficient transparency can be obtained in the full-color image with a single thermal fixing operation both in an area bearing toner of single color and in an area bearing toner of two or more colors, there may result a phenomenon called high-temperature offsetting in which the image is locally peeled off by the fixing roller because the layer 132 is sufficiently molten and tends to be separated from the layer 131.

On the other hand, if the molten viscosity of the transparent resin of the layer 132 is lower than that of the binder resin of the toner, the fixation is possible for the toner of a single color present on the layer 132, but is difficult for the toner of plural colors.

If the molten viscosity of the transparent resin is higher than 100 times, sufficient transparency of the image can be obtained in an image composed of scattered toner of a kind, but the transparency of the image may be deteriorated in a multi-color image or a high-density image, because the layer 132 does not deform sufficiently at the image fixation, whereby the toner remains in a non-flat state after fixation. Besides, because of insufficient adhesion between the layer 132 and the binder resin of the toner, the toner layer may be split therein, leading to the offsetting.

The thickness of the layer 132 is dependent on the particle size of the toner to be employed, but has to be at least a half of the average particle size of the toner, in order to obtain sufficient transparency in a low-density image area composed of a single particle layer of toner. On the other hand, a thickness exceeding 3 times the particle size of the toner may result in image blur or distortion or in cracks upon bending, due to an increased amount of molten resin. Consequently the preferred range of thickness is from $\frac{1}{2}$ to 2 times of the average particle size of the toner.

In the present invention, the average particle size of the toner is defined in the following manner.

The particle size is measured with Coulter Counter TA-II (manufactured by Coulter Corp.), connected to an interface (manufactured by Nihon Kagaku Kikai Co., Ltd.) for obtaining the particle number distribution, volume distribution, average particle number and average volume, and a personal computer Canon CX-1. Electrolyte solution employed is 1% aqueous solution of NaCl, prepared with E.P. grade sodium chloride.

Said electrolyte solution, in an amount of 100–150 ml, is added with a dispersant or a surfactant, preferably an alkylbenzene sulfonium salt in an amount of 0.1–5 ml, and a specimen of the toner is dispersed in an amount of 0.5–50 mg, preferably 2–20 mg.

The electrolyte solution in which said specimen is suspended is subjected to dispersion for 1–3 minutes with an ultrasonic disperser, and then to the measurement of particle size distribution in a particle range of 2–40$\mu$, with the aforementioned Coulter Counter TA-II equipped with a 100 $\mu$ aperture, whereby the average volume particle size is determined.

The laminate film of the present invention can be prepared by coating the transparent substrate film with solution of the resin of the layer 132 dissolved in a volatile organic solvent for example an alcohol such as methanol or ethanol or a ketone such as methylethylketone or acetone, for example by bar coating, dip coating, spray coating or spin coating, followed by drying. If necessary or desirable, an adhesion layer 133 having mutual solubility with the substrate film 131 and the upper coating layer 132 and high thermal resistance for the heat at fixation may be provided, as shown in FIG. 7B, in order to improve the adhesion of the layer 132 and the substrate film 131 thereby preventing the image peeling at or after the fixation. Examples of the resin employable as said adhesion layer include polyester resin, acrylate resin, methacrylate resin, styrene-acrylate copolymers, styrene-methacrylate copolymers etc.

In the following there will be given a specific example.

A transparent laminate film was prepared by coating a biaxially oriented PET film of a thickness of 100 $\mu$m and a maximum temperature of use of 150° C. with an acetone solution of polyester resin with a molten viscosity of $2\times10^4$ poise at 130° C. (solubility parameter about 11.0) by bar coating method to obtain an upper coating layer of a thickness of 16 $\mu$m after drying.

Said film, when employed in a full-color image forming process and fixed with the same oil application sequence as for the ordinary paper, could not enter the nip of the fixing roller and caused sheet jamming.

Such film, having the upper resin layer 132, shows marked difficulty of entry into said nip due to the undulation of the leading end resulting from the softening of said resin layer 132.

However the film could enter the nip by the sequence of the present invention, in which the oil application is started at 2 mm from the leading end of the film. The uncoated length of the film is preferably made variable.

For example, in case of an apparatus designed to apply the oil starting from a position of 2 mm from the leading end of the recording material, the distance is preferably made regulable within a range for example from +3 to −3 mm. In this manner the oil application at 2 mm is possible by suitable adjustment for each apparatus, in consideration of fluctuations among the apparatuses.

The uncoated length can be made variable by employing a variable timer for determining the delay time from the detection of the recording material in front of the nip of the fixing roller to the contact of the applicator roller and suitably varying said delay time.

The resinous recording material is detected by the photosensor 70 in the foregoing embodiment, but it may also be detected by a switch provided on an operation panel, for selecting the resinous recording material.

Also the releasing agent employed in the foregoing embodiment is identified as KF96, 300 CS of Shin-etsu Chemical, but the present invention is not dependent on such product or particular viscosity and is applicable to any releasing agent.

Furthermore, the releasing agent in the foregoing embodiment is applied to a necessary portion of the fixing roller, but it is also possible to liberally apply the releasing agent to the fixing roller 35, and then scrape off the releasing agent from any unnecessary portion.

Though the present invention has been explained by a preferred embodiment, it is not limited to such embodiment and is subject to any modification within the scope and spirit of the appended claims.

What is claimed is:

1. An apparatus for forming and fixing a toner image to a recording material, comprising:

(a) image-forming means for forming an unfixed toner image onto a recording material having a leading edge, said means being operable to form the unfixed toner image on the recording material in an image area separated from the leading edge by a non-image area, said non-image area comprising a strip of recording material devoid of said unfixed toner image and adjacent to said leading edge; and (b) fixing means for fixing the unfixed toner image, said fixing means comprising (i) paired rotary members having opposed contacting surfaces for pinching and conveying the recording material bearing said unfixed toner image;

(ii) applicator means for applying a coating of a releasing agent to an area of the contacting surface of at least one of the paired rotary members; and (iii) control means for controlling the area of application of the coating of releasing agent on the contacting surface;

wherein, when the recording material is resinous, said control means begins application of the coating to the contacting surface at a position on the contacting surface corresponding to a location on the recording material within the non-image area and away from the leading edge of the recording material, to ensure that a releasing-agent-free zone, that is also free of toner image, is created adjacent to the leading edge of the recording material.

2. An apparatus according to claim 1, wherein, when the recording material is resinous, said control means is operable to remove the releasing agent from a portion of the contacting surface, thereby creating a foremost limit of the coating of releasing agent on the contacting surface, such that the foremost limit of the coating is located on the contacting surface not at a location corresponding to the leading edge of the recording material, but at a location corresponding to a position on the recording material that is behind the leading edge but within the non-image area of the recording material, so as to create the releasing-agent-free zone that is also free of toner image adjacent to the leading edge of the recording material.

3. An apparatus according to claim 1, wherein said applicator means is operable to be contacted with and separated from said contacting surface at a point of application, said applicator means in separated state being operable to be brought into contact with said contacting surface after a portion of said contacting surface has rotated past the point of application, said portion corresponding to an area of the recording material coterminous with, and not greater than, the non-image area of the recording material.

4. An apparatus for forming and fixing a toner image to a recording material, comprising:

(a) image-forming means for forming an unfixed toner image onto a recording material having a leading edge, said means being operable to form the unfixed toner image on the recording material in an image area separated from the leading edge by a non-image area, said non-image area comprising a strip of recording material devoid of said unfixed toner image and adjacent to said leading edge; and (b) fixing means for fixing the unfixed toner image, said fixing means comprising (i) paired rotary members having opposed contacting surfaces for pinching and conveying the recording material bearing said unfixed toner image;

(ii) applicator means for applying a coating of a releasing agent to an area of the contacting surface of at least one of the paired rotary members; and (iii) control means for controlling the area of application of the coating of releasing agent on the contacting surface;

wherein, when said recording material is paper, said applicator means is operable to start the application of the releasing agent at a location on the contacting surface corresponding to a point before the leading edge of the recording material.

5. An apparatus according to claim 1, further including means for heating the rotary member to which the releasing agent is applied to a temperature sufficient to fix the unfixed toner image.

6. An apparatus according to claim 1, wherein the width of the releasing-agent-free zone at the leading edge of said resinous recording material is no more than 10 mm.

7. An apparatus according to claim 6, wherein the width of the releasing-agent-free zone is no more than 5 mm.

8. An apparatus according to claim 1, wherein the width of the releasing-agent-free zone at the leading edge of said resinous recording material is at least 0.5 mm.

9. An apparatus according to claim 8, wherein the width of the releasing-agent-free zone is at least 1 mm.

10. An apparatus according to claim 1, wherein said applicator means is adapted to apply the releasing agent at least onto the contacting surface of the paired rotary member contacting the unfixed toner image.

11. An apparatus for forming and fixing a toner image to a recording material, comprising:

(a) image-forming means for forming an unfixed toner image onto a recording material having a leading edge, said means being operable to form the unfixed toner image on the recording material in an image area separated from the leading edge by a non-image area, said non-image area comprising a strip of recording material devoid of said unfixed toner image and adjacent to said leading edge; and (b) fixing means for fixing the unfixed toner image, said fixing means comprising (i) paired rotary members having opposed contacting surfaces for pinching and conveying the recording material bearing said unfixed toner image;

(ii) applicator means for applying a coating of a releasing agent to an area of the contacting surface of at least one of the paired rotary members;

(iii) control means for controlling the area of application of the coating of releasing agent on the contacting surface; and (iv) selecting means for selecting a first mode of fixing with a first rotation speed of said paired rotary members, or a second mode of fixing with a second rotation speed of said paired rotary members, said second rotation speed being slower than said first rotation speed;

wherein, when the second mode is selected by said selecting means, said control means begins application of the coating to the contacting surface at a position on the contacting surface corresponding to a location on the recording material within the non-image area and away from the leading edge of the recording material, to ensure that a releasing-agent-free zone, that is also free of toner image, is created adjacent to the leading edge of the recording material.

12. An apparatus according to claim 11, wherein, upon selection of the second rotation speed by said selecting means, said control means is operable to remove the releasing agent from a portion of the contacting surface, thereby creating a foremost limit of the coating of releasing agent on the contacting surface, such that the foremost limit of the coating is located on the contacting surface not at a location corresponding to the leading edge of the recording material, but at a location corresponding to a position on the recording material that is behind the leading edge but within the non-image area of the recording material, so as to create the releasing-agent-free zone that is also free of toner image adjacent to the leading edge of the recording material.

13. An apparatus according to claim 11, wherein said applicator means is operable to be contacted with and separated from said contacting surface at a point of application, and, upon selection of the second rotation speed by said selecting means, said applicator means in separated state is operable to be brought into contact with said contacting surface after a portion of said contacting surface has rotated past the point of application, said portion corresponding to an area of the recording material coterminous with, and not greater than, the non-image area of the recording material.

14. An apparatus according to claim 11, wherein, upon selection of the first rotation speed by said selecting means, said applicator means is operable to start the application of the releasing agent at a location on the contacting surface corresponding to a point before the leading edge of the recording material.

15. An apparatus according to claim 11, further including means for heating the rotary member to which the releasing agent is applied to a temperature sufficient to fix the unfixed toner image.

16. An apparatus according to claim 11, wherein the width of the releasing-agent-free zone at the leading edge of said resinous recording material is no more than 10 mm.

17. An apparatus according to claim 16, wherein the width of the releasing-agent-free zone is no more than 5 mm.

18. An apparatus according to claim 11, wherein the width of the releasing-agent-free zone at the leading edge of said resinous recording material is at least 0.5 mm.

19. An apparatus according to claim 18, wherein the width of the releasing-agent-free zone is at least 1 mm.

20. An apparatus according to claim 11, wherein said applicator means is adapted to apply the releasing agent at least onto the contacting surface of the paired rotary member contacting the unfixed toner image.

21. An apparatus for forming and fixing a toner image to a recording material, comprising:

(a) image-forming means for forming an unfixed toner image onto a recording material having a leading edge and a detection portion adjacent to the leading edge;

(b) detecting means for detecting the nature of the recording material; and (c) fixing means for fixing the unfixed toner image, said fixing means comprising (i) paired rotary members having opposed contacting surfaces for pinching and conveying the recording material bearing the unfixed toner image;

(ii) applicator means for applying a coating of a releasing agent to the contacting surface of at lease one of the paired rotary members; and (iii) control means for controlling the area of application of the coating of releasing agent on the contacting surface;

wherein, said control means begins application of the coating to the contacting surface at a position on the contacting surface corresponding to a location on the recording material within the detection portion and away from the leading edge of the recording materials, to ensure that a releasing-agent-free zone is created on the detection portion of the recording material.

22. An apparatus according to claim 21, wherein, upon determination by said detecting means that the recording material is resinous, said control means is operable to remove the releasing agent from a portion of the contacting surface, thereby creating a foremost limit of the coating of releasing agent on the contacting surface, such that the foremost limit of the coating is located on the contacting surface not at a location corresponding to the leading edge of the recording material, but at a location corresponding to a position on the recording material that is behind the leading edge but within the detection portion of the recording material, so as to create the releasing-agent-free zone that is also free of toner image adjacent to the leading edge of the recording material.

23. An apparatus according to claim 21, wherein said fixing means is responsive to whether the recording material is resinous.

24. An apparatus according to claim 23, wherein, when the recording material is resinous, said fixing means is responsive to cause the paired rotary members to rotate at a slower rotation speed than when the recording material is other than resinous.

25. An apparatus according to claim 21, wherein said detecting means has an optical sensor with an output, and wherein the nature of the recording material is determined based on the output of said optical sensor.

26. An apparatus according to claim 21, wherein applicator means is operable to be contacted with and separated from said contacting surface at a point of application, said applicator means being controlled by said control means such that the timing of the application of the releasing agent to said contacting surface is controlled by the contact with, and separation from, the contacting surface.

27. An apparatus according to claim 21, further including means for heating the rotary member to which the releasing agent is applied to a temperature sufficient to fix the unfixed toner image.

28. An apparatus according to claim 21, wherein said applicator means is adapted to apply the releasing agent at least onto the contacting surface of the paired rotary member contacting the unfixed toner image.

29. An apparatus according to claim 21, functioning as a full-color image-forming apparatus operable to form multi-layered unfixed toner images onto the recording material, and operable to fix said unfixed toner images with color mixing.

30. An apparatus according to claim 21, wherein said control means is operable to regulate the timing of the application of the releasing agent at a point of application on the contacting surface.

* * * * *

UNITED STATES PATENT AND TRADEMARK OFFICE

CERTIFICATE OF CORRECTION

PATENT NO. : 5,424,819

DATED : June 13, 1995

INVENTOR(S) : TAKESHI MENJO

It is certified that error appears in the above-indentified patent and that said Letters Patent is hereby corrected as shown below:

Column 3,
line 20, "the" (first occurrence) should be deleted; and
line 48, "and" should be deleted.

Column 4,
line 54, "sharp melting" should read --sharp-melting--.

Column 6,
line 22, "$A_3$" should read --$A_1$--.

Column 8,
line 32, "a" should read --the--.

Column 14,
line 5, "lease" should read --least--; and
line 13, "materials," should read --material,--.

Signed and Sealed this

Seventeenth Day of October, 1995

Attest:

Bruce Lehman

BRUCE LEHMAN

Attesting Officer

Commissioner of Patents and Trademarks